US006623193B1

(12) United States Patent
Holland

(10) Patent No.: US 6,623,193 B1
(45) Date of Patent: Sep. 23, 2003

(54) ONE PIECE CLUTCH MECHANISM WITH DRIVE GEAR

(75) Inventor: Carl William Holland, Webster, NY (US)

(73) Assignee: Nu-kote International, Inc., Dallas, TX (US)

( * ) Notice: Subject to any disclaimer, the term of this patent is extended or adjusted under 35 U.S.C. 154(b) by 0 days.

(21) Appl. No.: 09/995,341

(22) Filed: Nov. 27, 2001

(51) Int. Cl.[7] ..... B65H 75/00
(52) U.S. Cl. ..... 400/242; 400/207; 242/571.3
(58) Field of Search ..... 400/242, 243, 400/244, 207, 208; 242/571.3, 571.4, 571.5, 486.8

(56) References Cited

U.S. PATENT DOCUMENTS

| | | | | |
|---|---|---|---|---|
| 4,327,874 A | * | 5/1982 | Bruno | 242/571.5 |
| 4,651,943 A | * | 3/1987 | Kawaguchi | 242/597.4 |
| 5,060,882 A | * | 10/1991 | Rousculp et al. | 242/421.3 |
| 5,100,250 A | * | 3/1992 | Suzuki et al. | 400/208 |
| D355,436 S | | 2/1995 | Suwa | |
| D383,743 S | | 9/1997 | Suwa et al. | |
| 5,775,821 A | | 7/1998 | Kato | |
| 5,795,083 A | * | 8/1998 | Gallagher | 400/207 |
| 5,897,256 A | | 4/1999 | Kameyama | |
| 5,913,621 A | | 6/1999 | Kameyama et al. | |
| 5,961,229 A | | 10/1999 | Kameyama | |
| 5,984,546 A | | 11/1999 | Kameyama | |
| D425,545 S | | 5/2000 | Ishida | |
| 6,079,886 A | | 6/2000 | Kameyama | |
| 6,109,801 A | * | 8/2000 | Mabit | 400/242 |
| 6,161,972 A | | 12/2000 | Kameyama et al. | |
| D442,211 S | | 5/2001 | Hayashi et al. | |
| 6,257,780 B1 | | 7/2001 | Ito et al. | |
| 6,398,434 B1 | * | 6/2002 | Corrigan, Jr. | 400/120.17 |
| 6,422,770 B1 | * | 7/2002 | de la Reguera | 400/208 |

FOREIGN PATENT DOCUMENTS

| | | |
|---|---|---|
| EP | 0 852 182 A1 | 7/1998 |
| EP | 0 931 672 A1 | 7/1999 |
| EP | 0 852 182 B1 | 11/1999 |
| EP | 1 000 765 A2 | 5/2000 |
| JP | 2001026156 A | 1/2001 |

OTHER PUBLICATIONS

JP 2001026156 A—Japan (Abstract in English).

* cited by examiner

*Primary Examiner*—Andrew H. Hirshfeld
*Assistant Examiner*—Dave A. Ghatt
(74) *Attorney, Agent, or Firm*—Fay, Sharpe, Fagan, Minnich & McKee, LLP

(57) ABSTRACT

An ink ribbon cartridge has first and second tubes (130, 132) for holding an ink ribbon. The tubes have slots formed in each end. Spindles (140, 142, 162, 164) are attached at the ends of the tubes. The spindles have a disk portion and an end which is received by tube slots. One of the spindles has a cantilevered member (196) which engages a slot of a tube and allows rotation of the tube in only one direction. The cantilevered member has an end having a radial edge (200) and a ramp (202) adjacent the straight side. Rotation of the spindle in one direction abuts the radial edge against a wall of the slot thus providing a positive drive and allowing rotation of the tube with the spindle. Rotation of the spindle in a second direction opposite to the first direction causes the ramp side to contact and slide along a wall of the slot, thus deflecting the cantilevered member inward toward the center of the spindle.

15 Claims, 4 Drawing Sheets

ONE PIECE CLUTCH MECHANISM WITH DRIVE GEAR

BACKGROUND OF THE INVENTION

This invention relates generally to an ink ribbon cartridge for use in a recording device, and more specifically to an ink ribbon cartridge including a one piece clutch mechanism used with a drive gear.

In a thermal ink ribbon cartridge, an ink ribbon is wound around a supply tube and extends to a take-up tube. An ink layer is formed on one surface of the ink ribbon. A spindle without a gear is provided at one end of each of the supply tube and the take-up tube while a spindle with a gear is provided at the other end of the supply tube and take-up tube. The spindles are selectively removable from the tubes.

At the time of ink ribbon replacement, each of the spindles is removed from a snap fit engagement with a corresponding hole in the housing of the ink ribbon cartridge. Then, the spindles are removed from their corresponding ends of the supply and take-up tubes. Replacement tubes with ink ribbon are installed onto the take-up and supply spindles and are attached to the ink ribbon cartridge housing. Subsequently, the ink ribbon cartridge is mounted in a printer or facsimile system. If the ink ribbon is improperly mounted or the direction of winding is reversed from the proper direction, the ink ribbon cannot be wound up thus resulting in a failure in printing.

Existing cartridges use a clutching mechanism for an ink ribbon take-up tube which has three separate components, an insert, a hub and a drive gear. As seen in FIG. 1A, a take-up tube 10 has an opening 12 extending therethrough and one or two slots 14 in each end of the tube. Tube 10, which is made of cardboard, has a plastic insert 20 which is inserted into one end of the tube and has tabs (not shown) which engage the slots 14 and snap the insert into place within the tube opening. The insert then remains as part of the take-up tube. The insert has a lip 22 which engages an end surface of the cardboard tube. The insert has an opening 24 extending therethrough. Referring to FIG. 1B, at an end 26 of the insert, which is opposite the end with lip 22 are a series of drive surfaces 28 and slip surfaces 30 formed by angled slots 32 equally spaced apart along a peripheral edge of the insert. The drive and slip surfaces extend axially inwardly from end surface 26 of the insert 20. The drive surfaces are substantially radial edges which form an abutment shoulder for drivingly engaging a drive gear. The slip surfaces have smooth, tapered surfaces or slopes which have a chord component which allows a drive lug to slip along the surfaces.

A hub 40 is snap fit onto a drive gear assembly 50. The hub has several prongs 42 which extend axially from a flat disk surface 44 and extend into matching slots 52 in the drive gear. The prongs are then locked into place within the gear and attach the hub to the gear. The hub further comprises a central portion 46 having an opening 47 therethrough and an end portion 48 with a slot 49 therethrough. The gear assembly includes an elongated leg portion 54 which extends through the opening in the central portion of the hub. Portion 54 includes a cantilever member 56 which is formed between grooves in the portion. The cantilever member has a drive lug 58 which extends through opening 47 of the hub and protrudes through slot 49. The drive lug is formed of a resilient material and can be depressed radially inwardly toward a center of the hub as the hub and drive gear are installed together. Once the drive lug is fully received in the hub, it extends radially outwardly through the slot of the hub and is locked within the slot.

The drive gear and hub assembly are then inserted into the plastic insert 20 in the cardboard tube. The drive lug is again depressed radially inwardly as the hub is axially inserted through an opening 24 in the insert 20 until the lug reaches the drive and slip surfaces at the end of the insert. The lug is depressed inwardly by the slip surfaces 30 and does not allow the drive gear to rotate the cardboard tube. That is, the drive lug allows the drive gear and hub to rotate counter-clockwise (see FIG. 1B) with respect to the slip surfaces and does not engage or lock to the insert. The drive gear and hub do not rotate the cardboard tube. However, if the hub and drive gear are rotated in the opposite direction, i.e. clockwise, the drive lug extends through one of the slots of the insert and engages one of the drive surfaces 28 thus providing a positive drive and rotating the insert and the cardboard tube in a clockwise manner along section AA. Thus, cardboard tube 10 can only rotate in one direction as driven by the drive gear.

A problem with this existing design is that the end of the cardboard tube with the plastic insert can only accommodate the drive gear with the hub and drive lug. This end is not compatible with any of the other spindles, i.e., the supply spindles or the other drive gear arrangements.

Thus, a one piece clutch mechanism which accomplishes the same function of permitting rotation of the take-up spool in only one direction would be desirable. This clutch mechanism would allow the end of the cardboard tube to be compatible with other drive gears and other spindles. Furthermore, no separate insert would be required within the cardboard tube. Accordingly, it is desirable to provide a new and improved ink ribbon cartridge which would meet the above stated needs and others and provide better, more advantageous results.

SUMMARY OF THE INVENTION

Generally speaking, the present invention relates to an ink ribbon cartridge which uses a drive gear that prevents improper winding of the take-up spool and thus preventing failure in printing.

More particularly, the invention relates to an ink ribbon cartridge with a one piece clutch mechanism which is inserted into a drive slot of a take-up tube. The take-up tube has a pair of slots which provide two surfaces against which a cantilever member of a drive gear contacts and drives the tube and rotate it in one direction. The drive gear cannot rotate the tube when the gear is rotated in the other direction. This is accomplished by including a ramp surface on one end of the cantilever member which is deflected inwardly when pushed against a slot in the take-up tube when rotated in the other direction. The gear rotates but the take-up tube remains stationary. When the gear is rotated in the one direction, the cantilevered member has a flat end which engages the slot within the tube and provides a positive drive when rotated against the tube thus rotating the tube along with the drive gear.

In particular, the present invention relates to an ink ribbon cartridge with an ink ribbon wound about first and second tubes. Spindles are received on each end of each tube. The tubes each have a first and second end with at least one slot formed in each end. The spindles have first and second ends where one of the ends has a disk portion and the other end is received by one of the slots in each tube. The second end of one of the spindles has a cantilevered member which engages a slot of a tube and rotates the tube in only one direction. The cantilevered member elastically deforms upon deflection toward a center of the spindle so that the spindle rotates relative to the stationary tube in the opposite direction.

The cantilevered member has an end having a radial edge and a ramp side adjacent the radial edge. The radial edge is generally parallel to a slot of one of the tubes. Rotation of the spindle in one direction abuts the radial edge against a wall of the slot thus providing a positive drive and allowing rotation of the tube with the spindle. Rotation of the spindle in a second direction opposite to the first direction causes the ramp side to contact and slide along a wall of the slot, thus deflecting the cantilevered member inward toward the center of the spindle. The spindle is rotated and the tube is not rotated when the cantilevered member deflects inwardly.

One advantage of the present invention is the provision of a one piece clutch mechanism for providing a drive gear for rotating a take-up spool in only one direction.

Another advantage of the present invention is the provision of a one piece clutch mechanism which does not have a separate insert to be inserted into one end of a take-up tube thus allowing each end of the tube to receive take-up or supply spindles.

Yet another advantage of the present invention is the provision of a one piece clutch mechanism which minimizes the number of parts and is easy to manufacture.

Still other aspects and advantages of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1A:
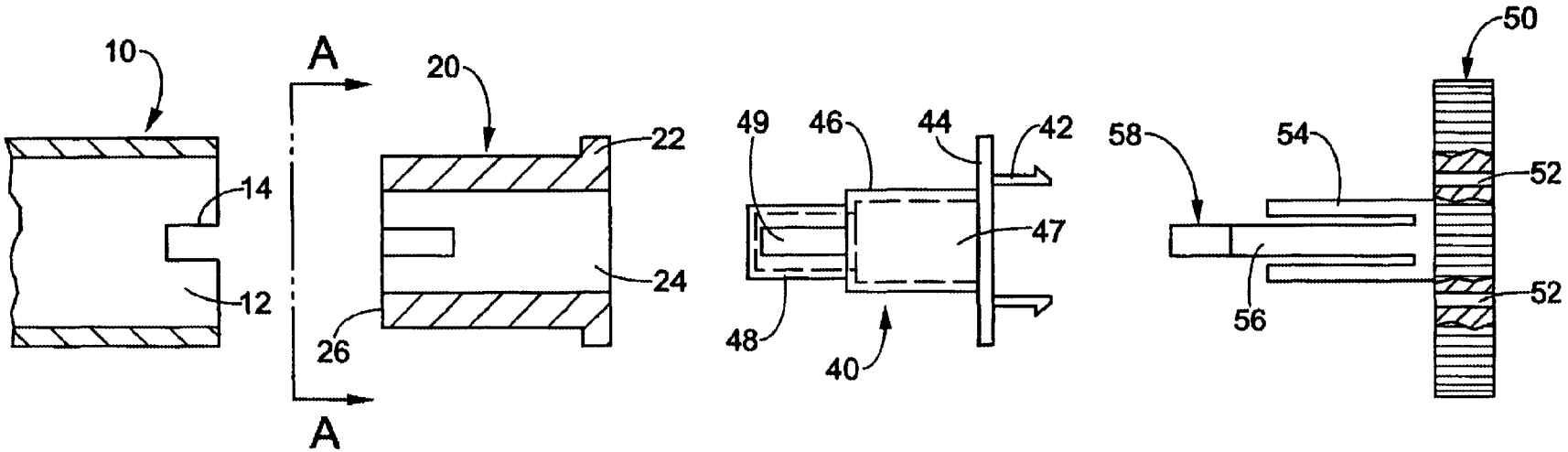
FIG. 1A (PRIOR ART)
FIG. 1A is a elevational view in partial cross section illustrating a tube, a tube insert, a hub, and a drive gear according to a prior art design.
Figure 1B:
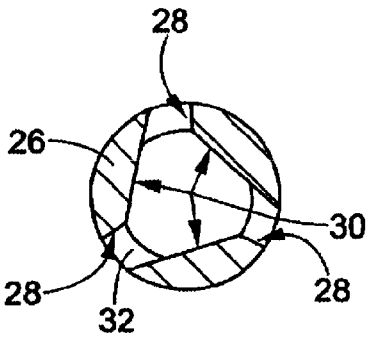
FIG. 1B (PRIOR ART)
FIG. 1B is a end view in cross section of the insert of FIG. 1A.
Figure 2:
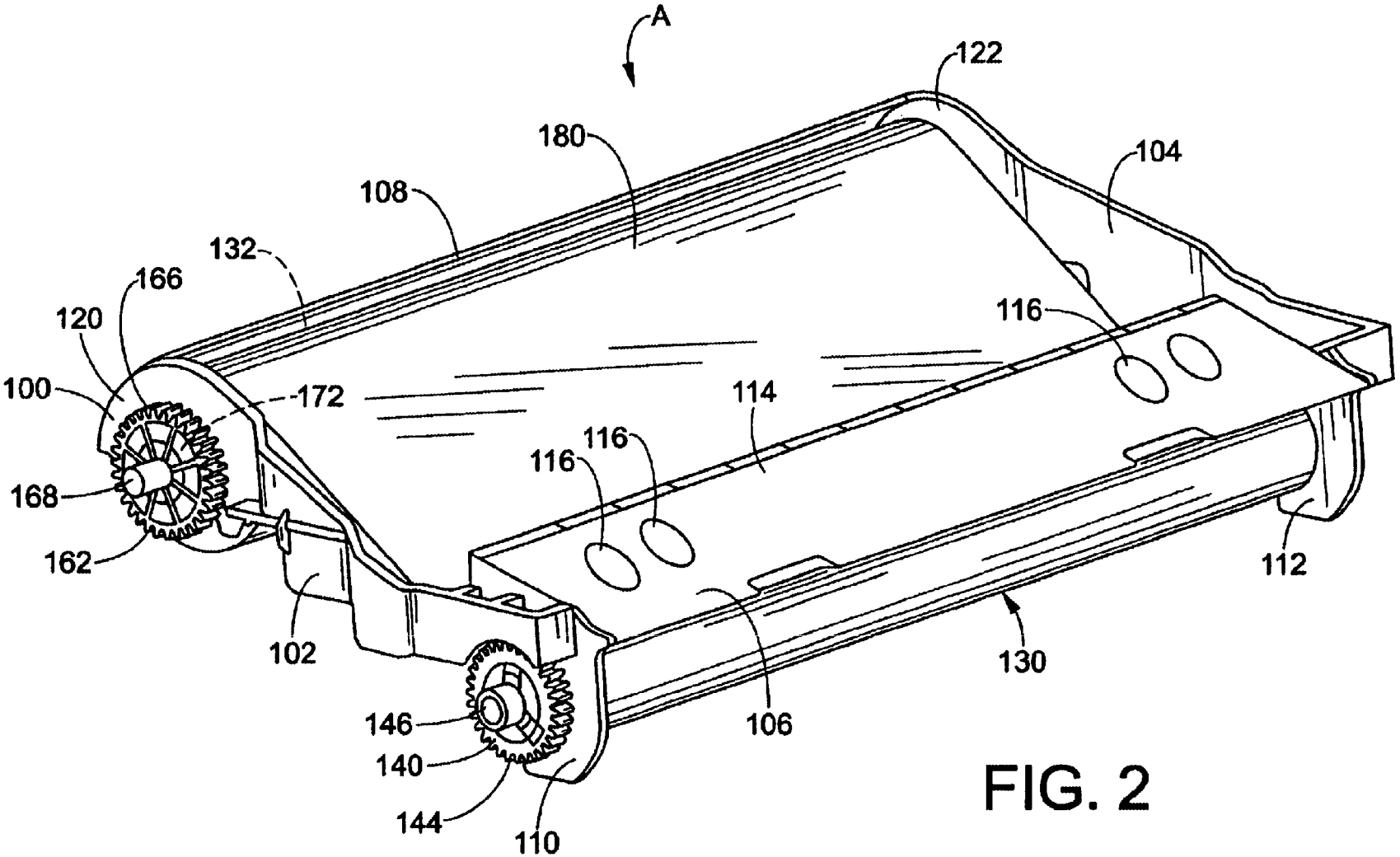
FIG. 2 is a perspective view of an ink ribbon cartridge in accordance with the present invention.

Referring now to the drawings, wherein the showings are for purposes of illustrating the preferred embodiment of the invention only and not for purposes of limiting same, FIG. 2 shows an ink ribbon cartridge in accordance with a preferred embodiment of the present invention.

More particularly, an ink ribbon cartridge A comprises a housing 100, having a first wall 102, a second wall 104, a third wall 106, and a fourth wall 108. The housing is preferably unitarily formed of resin. First and second walls 102, 104 form connection members which extend between and connect the third wall to the fourth wall. The first and second walls are spaced apart and generally parallel to each other. Similarly, the third and fourth walls are spaced apart and generally parallel to each other. The third wall 106 comprises wall sections 110, 112 which extend from a wall portion 114 formed between the walls. Each wall 110, 112 has an opening for receiving a spindle attached to a take-up spool or tube 130 which extends between walls 110, 112. Wall 114 partially covers tube 130 and is generally parallel thereto. Preferably, the wall section 114 has a flat surface extending between the walls 110, 112. Wall 114 also preferably comprises a series of spaced apart slots or openings 116 which are used to grasp the ribbon cartridge by a user's fingers and to lift and install the ink cartridge into a printer.

Wall section 108 has a generally semi-cylindrical shape and comprises wall portions 120, 122 which extend downwardly from a top surface of the wall as shown in FIG. 2. Sections 120, 122 each comprise an opening for receiving a spindle attached to a supply tube 132 which extends between the two sections.

The take-up tube and supply tube are each preferably made of cardboard. Other material may be used without departing from the scope of the present invention. Spindles 140, 142 are attached to opposite ends of the tube 130. Spindle 140 has a gear section 144. Spindle 142 does not have a gear. Each spindle is preferably molded of a resin material or thermoplastic. Other materials, however, may be used without departing from the scope of the present invention. Each spindle 140, 142 comprises a cylindrical portion 146, 148, respectively. Each spindle also has a flat disk section 150, 152, respectively.

The supply spool or tube 132 extends between walls 120, 122. A spindle 162 is attached to one end of the tube and a spindle 164 is attached at the other end. Spindle 164 has a gear section 166. Spindle 164 does not have a gear section. Each spindle comprises a cylindrical section 168, 170, respectively. Each spindle also has a flat disk portion 172, 174, respectively.

An ink ribbon 180 extends between and is connected onto take-up tube 130 and supply tube 132. The ink ribbon has an ink layer on one side. The ink ribbon is formed from a broad width resin film and has an ink surface onto which the ink layer is formed.

Figure 3:
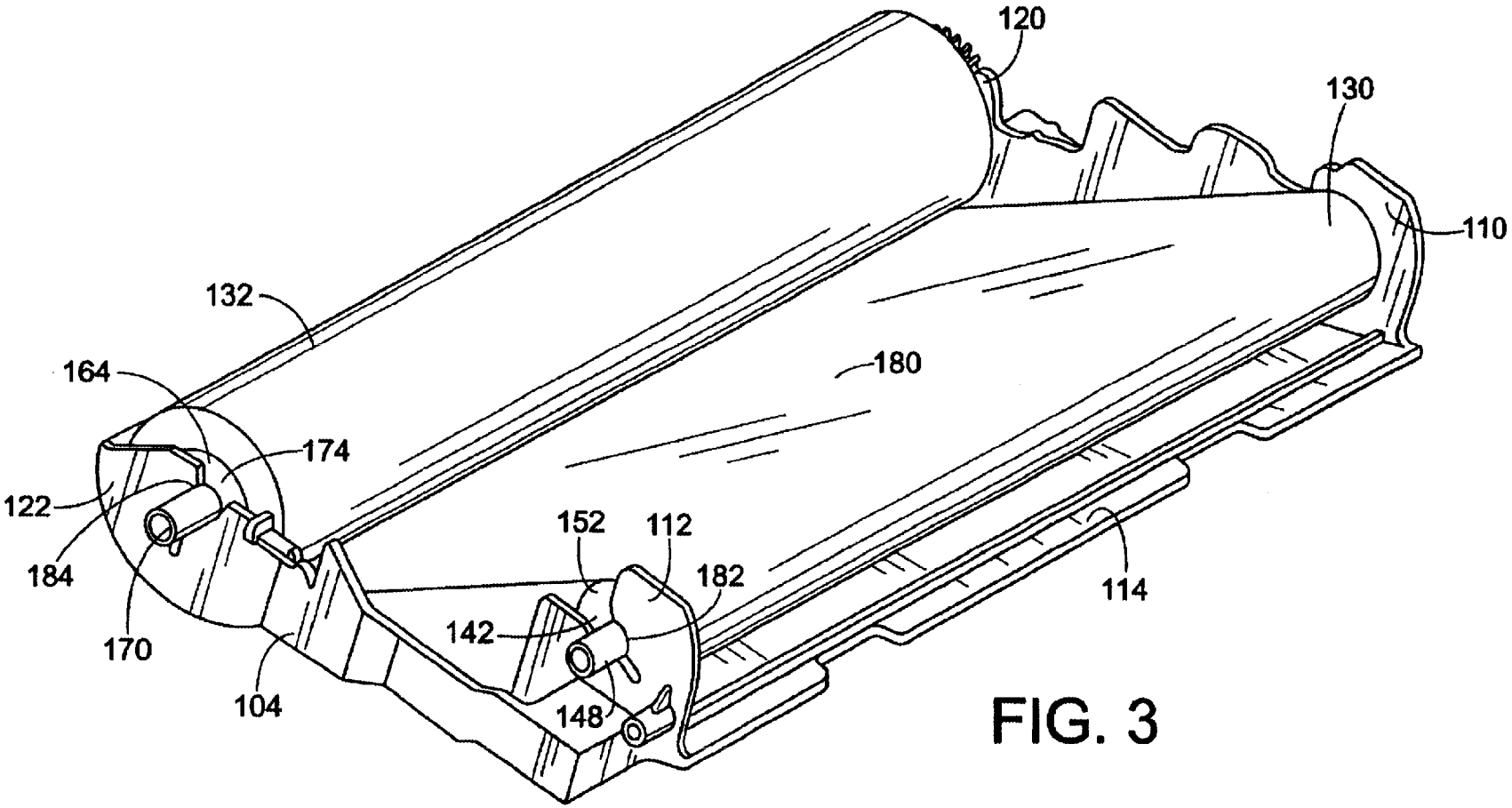
FIG. 3 is a another perspective view of the ink ribbon cartridge of FIG. 2.

Each of the spindles 142, 164 are received and semi-circular notches or cut-outs 182, 184 within walls 112, 122 of the cartridge. Similarly, the gear spindles 140, 162 are received in semi-circular notches (not shown) in walls 110, 120. As seen in FIG. 3, the cylindrical portions of each spindle are snap fit into the notches in the housing.

At each end of each tube is one or two slots 190, preferably 180 degrees apart, which receive tabs extending from the ends of each spindle opposite the ends received in the notches in the housing.

Figure 4A:
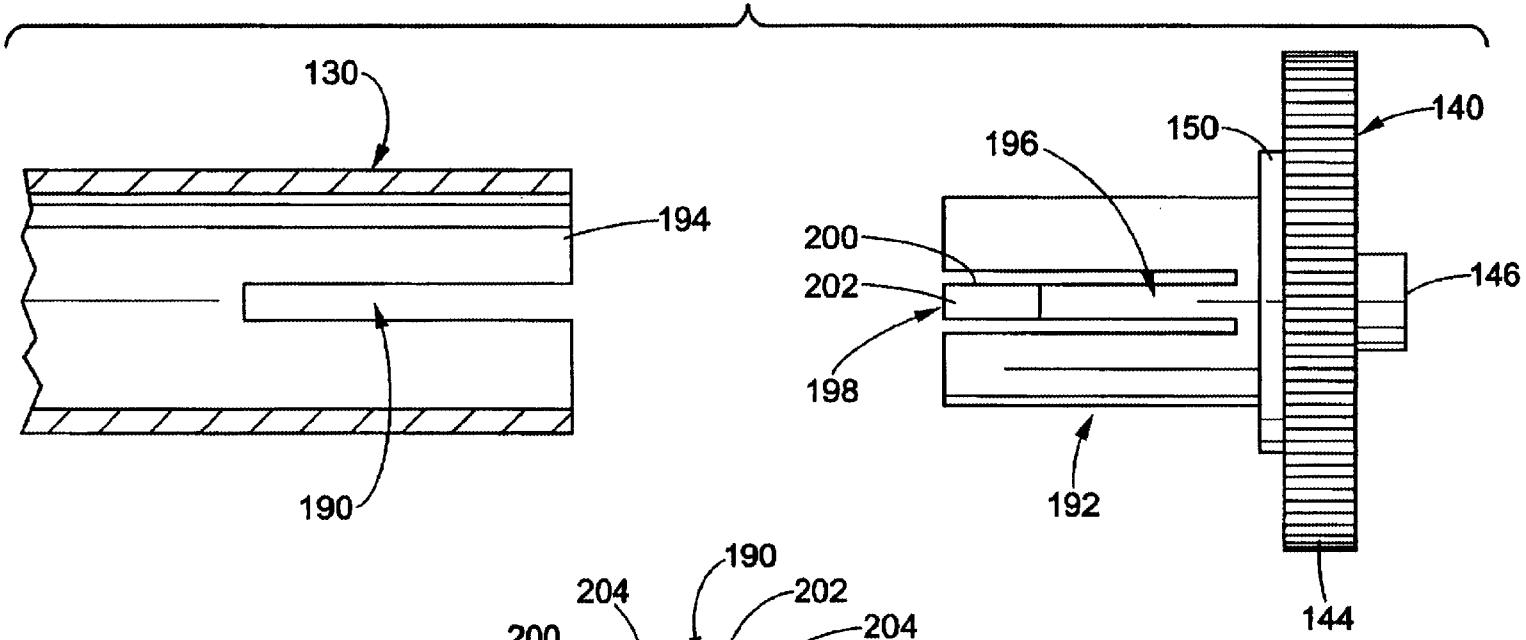
FIG. 4A is a top plan view of a drive gear and a top plan view in cross section of a tube having a slot therein formed in accordance with a preferred embodiment of the present invention; and, FIG. 4B is a partial side elevational view in cross section illustrating a slot in the tube and a ramp surface of the drive gear of FIG. 4A.
Figure 4B:
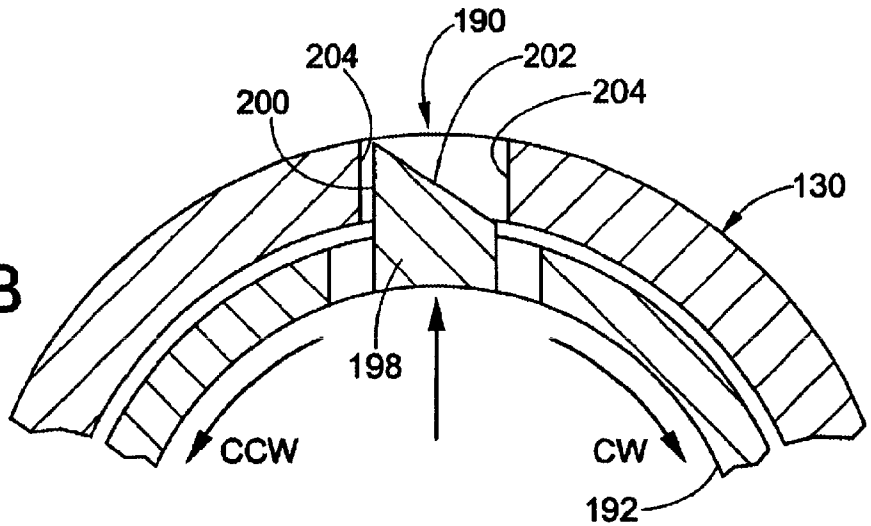

Referring now to FIG. 4A, gear spindle 140 has a hub 192 which is inserted through an opening 194 of the tube 130. Hub 192 has a cantilever member 196 which is formed within a groove of the hub. The cantilever member is preferably made of a flexible plastic. The cantilevered member is elastically deformed upon deflection toward a center of the spindle. At one end of the member is a ramped end 198 which has a radial edge 200 and a ramp 202 as seen in FIG. 4B. The radial edge is generally parallel to slot 190 and the ramp is disposed at an angle to the slot. If the spindle is rotated in a clockwise direction as seen in FIG. 4B, the ramp 202 contacts a wall 204 of slot 190. Member 196 is then deflected inwardly toward the center of the hub and ramp 202 slides along wall 204 until the cantilevered member is deflected away from the slot. The member does not engage slot 190 or allow the tube 130 to rotate.

If the spindle is rotated in a counter-clockwise direction, as shown in FIG. 4B, then radial edge 200 engages wall 204 of slot 190 and rotates the tube 130 along with the hub and drive gear. That is, ramped end 198 remains within slot 190 and acts as a positive drive. Thus, the gear spindle 140 acts as a one piece clutch mechanism which allows rotation of the take-up tube in only one direction. The same result occurs if the cantilevered member engages a second slot 190 180 degrees apart from the first slot. The take-up tube slots are compatible with supply spindles and other take-up spindles. No other pieces or inserts are required. Although the drive gear shown allows rotation of the tube in the counter clockwise direction, it should be noted that the drive gear spindle could also be designed to allow rotation in only the clockwise direction.

The invention has been described with reference to a preferred embodiment obviously, alterations and modifications will occur to others upon a reading and understanding of this specification. The specification is intended to include all such modifications and alterations insofar as they come within the scope of the appended claims or the equivalents thereof.

Having thus described the preferred embodiment, the invention is now claimed to be:

1. An ink ribbon cartridge, comprising:

an ink ribbon with a layer of ink on one side thereof;

first and second tubes holding said ink ribbon, a slot formed in a first end of the first tube; and, a plurality of spindles, one of said spindles including a cantilever member which is received in the slot and engages said first tube and allows selective rotation of said tube in only one direction, wherein said cantilever member comprises an end having a radial edge and a ramp adjacent thereto, wherein said cantilever member is flexible and selectively deflects inwardly toward a center of said spindle.

2. The ink ribbon cartridge of claim 1, wherein said radial edge is generally parallel to said slot of said first tube, wherein rotation of said spindle in a first direction abuts said radial edge against a wall of said slot thus providing a positive drive and allowing rotation of said first tube with said spindle.

3. The ink ribbon cartridge of claim 2, wherein said ramp is positioned at an angle with respect to said slot, wherein rotation of said spindle in a second direction opposite said first direction causes said ramp to contact and slide along a wall of said slot of said first tube, thus deflecting said cantilever member inward toward a center of said spindle.

4. The ink ribbon cartridge of claim 2, wherein said cantilever member elastically deforms upon deflection toward a center of said spindle.

5. The ink ribbon cartridge of claim 1, wherein said spindles each have a first end and a second end opposite said first end, wherein each first end has a disk portion, wherein said first and second tubes each have first and second ends, wherein each of said tube ends has a slot formed in said ends, wherein said second ends of said spindles are received by one of said slots in said tubes.

6. The ink ribbon cartridge of claim 1, wherein said first and second tubes are made of cardboard.

7. The ink ribbon cartridge of claim 1, wherein said spindles are each made of thermoplastic.

8. The ink ribbon cartridge of claim 1, wherein said cantilever member is formed of a flexible plastic.

9. A clutch device for use with an associated take-up spool for an ink ribbon cartridge, comprising:

a first end having a disk portion and a gear portion adjacent said disk portion;

a second end opposite said first end, said second end comprising a spindle;

wherein said spindle includes a cantilever member having a radial edge and a ramp portion adjacent said radial edge, wherein said cantilever member is dimensioned for engaging a slot in an end of said take-up spool, wherein said radial edge is generally parallel to said slot, wherein rotation of said spindle in a first direction abuts said radial edge against a wall of said slot thus providing a positive drive and allowing rotation of said spindle and said take-up spool.

10. The clutch device of claim 9, wherein rotation of said spindle in a second direction, opposite said first direction, causes said ramp portion to contact a wall within said slot, thus deflecting said cantilever member inward toward the center of said spindle.

11. The clutch device of claim 10, wherein said spindle rotates relative to said take-up spool when said cantilever member deflects inwardly.

12. The clutch device of claim 11, wherein said cantilever member is flexibly mounted for deflection toward the center of said spindle.

13. The clutch device of claim 9, wherein said spindle is made of thermoplastic.

14. The clutch device of claim 9, wherein said cantilever member is formed of plastic.

15. The clutch device of claim 14, wherein said cantilever member is formed by at least one groove extending through a portion of said spindle.

* * * * *